US012624903B2

(12) United States Patent
Smith et al.

(10) Patent No.: US 12,624,903 B2
(45) Date of Patent: May 12, 2026

(54) SUBCOOLER FOR CARBON DIOXIDE DISTRIBUTION SYSTEMS

(71) Applicant: TOMCO2 SYSTEMS COMPANY, Loganville, GA (US)

(72) Inventors: Hugh Smith, Rome, GA (US); John Romanos, Mobile, AL (US)

(73) Assignee: TOMCO2 SYSTEMS COMPANY, Loganville, GA (US)

( * ) Notice: Subject to any disclaimer, the term of this patent is extended or adjusted under 35 U.S.C. 154(b) by 180 days.

(21) Appl. No.: 17/516,367

(22) Filed: Nov. 1, 2021

(65) Prior Publication Data

US 2022/0136783 A1 May 5, 2022

Related U.S. Application Data

(60) Provisional application No. 63/107,503, filed on Oct. 30, 2020.

(51) Int. Cl.

| | |
|---|---|
| ***F28D 21/00*** | (2006.01) |
| ***F28D 1/047*** | (2006.01) |
| ***F28F 27/02*** | (2006.01) |

(52) U.S. Cl.

CPC ..... *F28D 21/0017* (2013.01); *F28D 1/0472* (2013.01); *F28F 27/02* (2013.01)

(58) Field of Classification Search

CPC ..... F28D 21/0017; F28D 1/0472; F28D 1/0213; F28D 2021/0033; F28D 7/024; F28F 27/02; F28F 2250/06; F25B 2400/0417; F25B 40/02; F25B 9/008; A23B 4/037; A23B 4/09; F25D 29/001; F17C 3/10; F17C 2227/0339; F17C 2227/0353; F17C 9/00

See application file for complete search history.

(56) References Cited

U.S. PATENT DOCUMENTS

| | | | | |
|---|---|---|---|---|
| 3,681,930 A | | 8/1972 | Tyree, Jr. | |
| 3,754,407 A | | 8/1973 | Tyree, Jr. | |
| 3,815,377 A | | 6/1974 | Tyree, Jr. | |
| 3,952,530 A | | 4/1976 | Tyree, Jr. | |
| 4,296,610 A | * | 10/1981 | Davis | F17C 9/00 62/50.1 |
| 4,377,402 A | | 3/1983 | Crowe et al. | |

(Continued)

FOREIGN PATENT DOCUMENTS

| | | | | |
|---|---|---|---|---|
| DE | 102013014912 A1 | * | 3/2015 | F25D 3/12 |
| EP | 2 657 631 A2 | | 10/2013 | |
| WO | 2011/029825 A2 | | 3/2011 | |

OTHER PUBLICATIONS

DE102013014912 Machine Translation (Year: 2015).*

*Primary Examiner* — Travis Ruby
(74) *Attorney, Agent, or Firm* — Merchant & Gould, P.C.

(57) ABSTRACT

A carbon dioxide distribution system and carbon dioxide subcooler useable within such a system are disclosed. The carbon dioxide subcooler includes an insulated enclosure forming an interior volume, the insulated enclosure having a supply inlet, a supply outlet, and a cooling inlet in fluidic communication with the interior volume. The carbon dioxide subcooler further includes a coil supply tube positioned within the interior volume, the coil supply tube being fluidically connected between the supply inlet and the supply outlet.

14 Claims, 10 Drawing Sheets

(56) References Cited

U.S. PATENT DOCUMENTS

| | | | | |
|---|---|---|---|---|
| 5,386,709 | A * | 2/1995 | Aaron | F25B 40/02 62/79 |
| 5,511,379 | A * | 4/1996 | Gibot | F25D 29/001 62/54.3 |
| 10,502,483 | B2 | 12/2019 | Gushanas et al. | |
| 2005/0090814 | A1* | 4/2005 | Lalonde | A61B 18/02 606/22 |
| 2007/0028648 | A1* | 2/2007 | Meinass | F17C 6/00 62/606 |
| 2011/0126583 | A1 | 6/2011 | McCormick et al. | |
| 2014/0216601 | A1* | 8/2014 | Henrich | F17C 5/02 141/82 |
| 2015/0251288 | A1* | 9/2015 | Kudaravalli | F17C 9/00 409/137 |
| 2019/0331298 | A1* | 10/2019 | Thor | F17C 5/02 |

* cited by examiner

200

SUBCOOLER FOR CARBON DIOXIDE DISTRIBUTION SYSTEMS

CROSS-REFERENCE TO RELATED APPLICATIONS

This application claims priority to U.S. Provisional Application Ser. No. 63/107,503, filed Oct. 30, 2020 and entitled "Subcooler for Carbon Dioxide Distribution Systems," the disclosure of which is incorporated herein by reference in its entirety.

BACKGROUND

Carbon dioxide is often stored in liquid form at elevated temperatures due to pressure in bulk storage tanks, for later distribution in a number of industrial processes, such as refrigeration, use as food service, shield gas, providing a pH balance in water treatment plants, in fire suppression systems, or oil/gas recovery systems. Carbon dioxide tanks are typically maintained with a temperature in the range of −10 to 2.7 degrees Fahrenheit, and at pressures of about 245 pounds per square inch (PSIG) to 305 pounds per square inch (PSIG), such that the carbon dioxide contained therein is maintained in liquid form.

When required to be used in many industrial and food applications, such stored carbon dioxide can be routed to a piece of end equipment via an insulated conduit (tube). In addition to the elevated storage tank temperature, the piece of end equipment may be at a location distant from the storage tank; as such, the liquid carbon dioxide within the supply tube between the supply tank and the end equipment may warm as it approaches the end equipment, since, as the carbon dioxide travels through the supply tube, it will gradually warm due to surrounding (ambient) heat. This along with the elevated carbon dioxide coming from the storage tank may have a detrimental effect on the end equipment, which may be expecting to receive carbon dioxide in liquid form at a much colder temperature. For example, frosting or other clogging events may occur due to receipt of the supply carbon dioxide at an unexpectedly-high (warm) temperature. In some cases insulation may be applied to the supply tube, or a vacuum jacketed option is offered to mitigate additional warming effects in the supply line only but may be difficult to avoid adverse performance effects when the distance between the supply tank and end equipment is long. Accordingly, it is desirable to identify convenient ways in which a temperature of supply carbon dioxide can be maintained as it is transported to end equipment for use.

SUMMARY

In general, the present disclosure relates to a subcooler that can be used in carbon dioxide distribution systems. The subcooler uses a portion of the supply of carbon dioxide to form dry ice within an interior volume, which in turn is useable to cool a primary supply line. Such a subcooler may be used to ensure a supply of carbon dioxide is at an appropriate temperature when it reaches end equipment.

In a first aspect, a carbon dioxide distribution system includes a supply tank, end equipment, and a carbon dioxide supply line fluidically connected between the supply tank and the end equipment. The system further includes a subcooler located along the carbon dioxide supply line. The subcooler includes an insulated enclosure forming an interior volume, the insulated enclosure having a supply inlet fluidically connected to the supply tank via the carbon dioxide supply line, a supply outlet fluidically connected to the end equipment via the carbon dioxide supply line, and a cooling inlet in fluidic communication with both the carbon dioxide supply line and the interior volume. The subcooler further includes a coil supply tube positioned within the interior volume, the coil supply tube being fluidically connected between the supply inlet and the supply outlet.

In a second aspect, a carbon dioxide subcooler is disclosed. The carbon dioxide subcooler includes an insulated enclosure forming an interior volume, the insulated enclosure having a supply inlet, a supply outlet, and a cooling inlet in fluidic communication with the interior volume. The carbon dioxide subcooler further includes a coil supply tube positioned within the interior volume, the coil supply tube being fluidically connected between the supply inlet and the supply outlet.

In a third aspect, a method of operating a subcooler within a carbon dioxide distribution system is disclosed. The method includes determining whether a first temperature within an interior volume of a subcooler is within an acceptable operating range at a first time, the subcooler being connected to a supply line between a supply tank and end equipment. The method further includes, based on a determination that the temperature is outside of the acceptable operating range, actuating a first valve to introduce carbon dioxide from the supply line into an interior volume of the subcooler. The method also includes determining whether a second temperature within the interior volume of the subcooler is within the acceptable operating range at a second time. The method includes, based on a second determination that the second temperature is within the acceptable operating range, actuating a second valve to route carbon dioxide to flow through a coil passing through the interior volume of the subcooler to route the carbon dioxide between the supply tank and the end equipment.

DETAILED DESCRIPTION

As briefly described above, embodiments of the present invention are directed to a carbon dioxide distribution system that includes a subcooler that may be useable to reduce a temperature of supplied carbon dioxide to end equipment. The subcooler, according to example embodiments, may utilize an insulated housing into which a portion of the supplied carbon dioxide is supplied to form a dry ice (solid carbon dioxide) cooling environment. A coil may be used for a primary supply of liquid or gaseous carbon dioxide may pass through the cooling environment, thereby cooling the supplied carbon dioxide.

In example applications, such a carbon dioxide distribution system may include the subcooler at a location proximate to end equipment. Such an arrangement can ensure that the end equipment receives a supply of carbon dioxide that is within an expected temperature range, despite any variance in temperature that may otherwise occur due to warming of the carbon dioxide supply while being transported via supply lines from a supply tank to the end equipment. Furthermore, this has the advantage that no other cooling/refrigeration systems are used; rather, a portion of the supply carbon dioxide provides the cooling effect.

In example embodiments, more than one such subcooler may be included along a supply line, depending upon the temperature range that is required to be maintained and the length of supply line extending between a supply of carbon dioxide and the end equipment.

Figure 1:
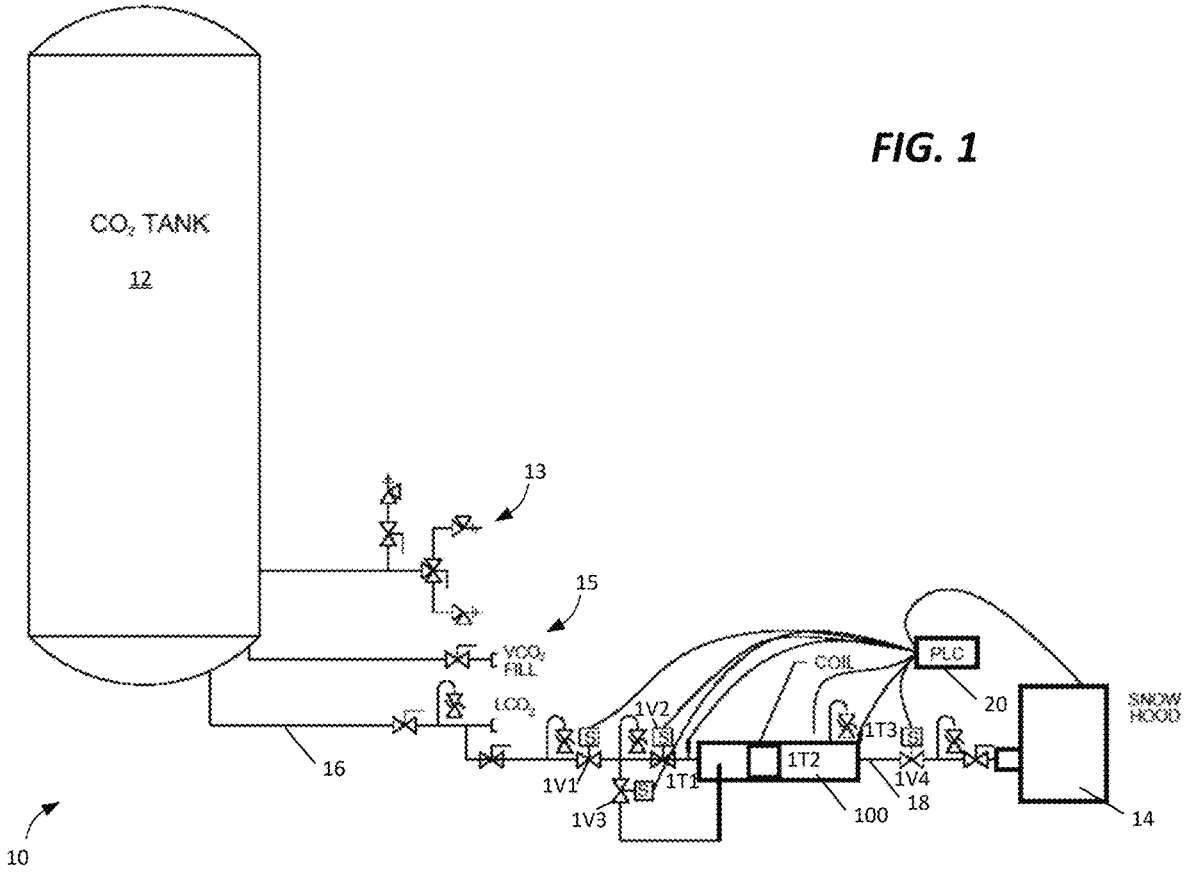
FIG. 1 illustrates an example carbon dioxide distribution system, according to an example embodiment of the present disclosure.

FIG. 1 illustrates an example carbon dioxide distribution system 10, according to an example embodiment of the present disclosure. The carbon dioxide distribution system 10 includes a carbon dioxide supply tank 12, as well as end equipment 14. A carbon dioxide supply line 16 is fluidically connected between the carbon dioxide supply tank 12 and end equipment 14.

The carbon dioxide to supply a tank 12 may, in some cases, correspond to a large bulk supply tank of carbon dioxide, typically stored in liquid form. The carbon dioxide supply tank 12 will generally be an insulated supplied tank that is stationary at a facility where carbon dioxide is used. The carbon dioxide supply tank may include one or more release valves 13, as well as a filling valve 15.

The end equipment 14 may be any type of equipment configured to utilize pressurized liquid or gaseous carbon dioxide. In the example shown, the end equipment 14 is illustrated as a snow hood. However, a variety of other types of equipment may be provided. For example, such equipment may include a dry ice pelletizer, a block press, a chiller and/or food processing equipment (e.g., a blender or in packaging), or other types of equipment where carbon dioxide is used for a cooling process.

In the embodiment shown, a subcooler 100 is located between the carbon dioxide supply tank 12 and the end equipment 14 along the supply line 16. In general, the subcooler 100 is used to reduce a temperature of the supplied carbon dioxide from the supply tank 12 before that supply reaches the end equipment 14. As discussed further below, the subcooler 100 may utilize a portion of the supplied carbon dioxide in cooling the supply carbon dioxide. In such an example, a coil tube may extend through the subcooler interior volume, carrying supply carbon dioxide to the end equipment 14. However, the interior volume may also have an inlet that accepts carbon dioxide from the supply tube 16. Furthermore, the interior volume may be maintained at a lower pressure than the supply tube 16, such that, when carbon dioxide is introduced into the interior volume (which may further be populated with glycol) dry ice is formed within the interior volume (but external to the coil). This may be accomplished, for example, with a pressure relief valve that provides an outlet from the subcooler 100 and is actuated when a pressure of the interior volume exceeds a threshold. The dry ice formed within the interior volume of the subcooler 100 may therefore fall to a temperature far below the temperature of the supply tube due to the decrease in pressure experienced. Accordingly, the dry ice/glycol mixture within the interior volume may provide heat exchange with the supply carbon dioxide passing through the coil, and toward the end equipment 14. Accordingly, liquid carbon dioxide may be provided to the end equipment 14 at a lower temperature, leading to more efficient operation of such end equipment and avoidance of malfunctions due to frost build-up or other similar issues. Further details regarding an example structure of such a subcooler is provided in further detail below in conjunction with FIG. 2.

As part of a subcooler assembly, and in some cases considered part of the subcooler, a plurality of valves may be provided to control flow of carbon dioxide from the supply tank 12 either to or through the subcooler 100. For example, valves 1V1, 1V2, 1V3, and 1V4 may be used to control flow of carbon dioxide in accordance with the methods described below in conjunction with FIG. 3. Additional valves may be provided as well, either along the supply line 16 or as pressure relief valves from the subcooler as discussed below.

In the example shown, valve 1V1 is positioned upstream of the subcooler 100, and upstream of a split in the supply tube 16 that delivers carbon dioxide to the subcooler 100 and through the subcooler 100, respectively. Valve 1V2 is positioned after the split in the supply tube 16, and along a fluid path between the supply tank 12 and the end equipment 14. Valve 1V3 is positioned along a split line that stems from the supply tube 16, and connects to a cooling inlet that receives carbon dioxide into the interior volume of the subcooler 100. Additionally, a downstream valve 1V4 is positioned between the subcooler 100 and the end equipment 14 to control a rate of flow to the end equipment 14.

In the example shown, a controller 20, shown as a programmable logic controller, may be used to control opening of valves 1V1, 1V2, 1V3, and 1V4 to manage the extent of cooling provided by the subcooler. In such an arrangement, each of valves 1V1, 1V2, 1V3, and 1V4 may be electronically controlled solenoid-based valves. In operation, when a supply is to be provided to the end equipment 14 from the supply tank, valves 1V1, 1V2, and 1V4 may be open, and valve 1V3 may be closed.

In addition to the valves, one or more temperature probes may be positioned proximate to the subcooler 100 to monitor temperature of carbon dioxide within the supply tube 16, and determine whether that supply carbon dioxide is appropriate to be delivered to end equipment. In the example shown, three temperature probes, 1T1, 1T2, and 1T3 are shown. Temperature probe 1T1 is located at the inlet to the subcooler (e.g., proximate valve 1V2), while temperature probe 1T2 is located within the subcooler 100 (e.g., in the interior volume, optionally within a glycol/dry ice mixture used for cooling the coil carrying the supply of carbon dioxide to the end equipment). A third temperature probe 1T3 may be located at the exit of the subcooler, between the subcooler 100 and end equipment (proximate valve 1V4). In general, when within an acceptable range of temperatures, the controller 20 may allow continued, "pass through" operation of the subcooler 100. However, if a temperature within the subcooler 100 exceeds a particular threshold, the controller may cause valves 1V2 and 1V4 to close, and open valve 1V3. Accordingly, carbon dioxide may be introduced into the subcooler 100, rather than through the coil passing through the subcooler. Once a temperature read by the temperature probe reaches an appropriate level, valve 1V3 may be closed, and valves 1V2 and 1V4 reopened to result supply of carbon dioxide to end equipment 14. Details regarding such coordinated temperature monitoring and actuation of valves are provided below in conjunction with FIG. 3.

Figure 2:
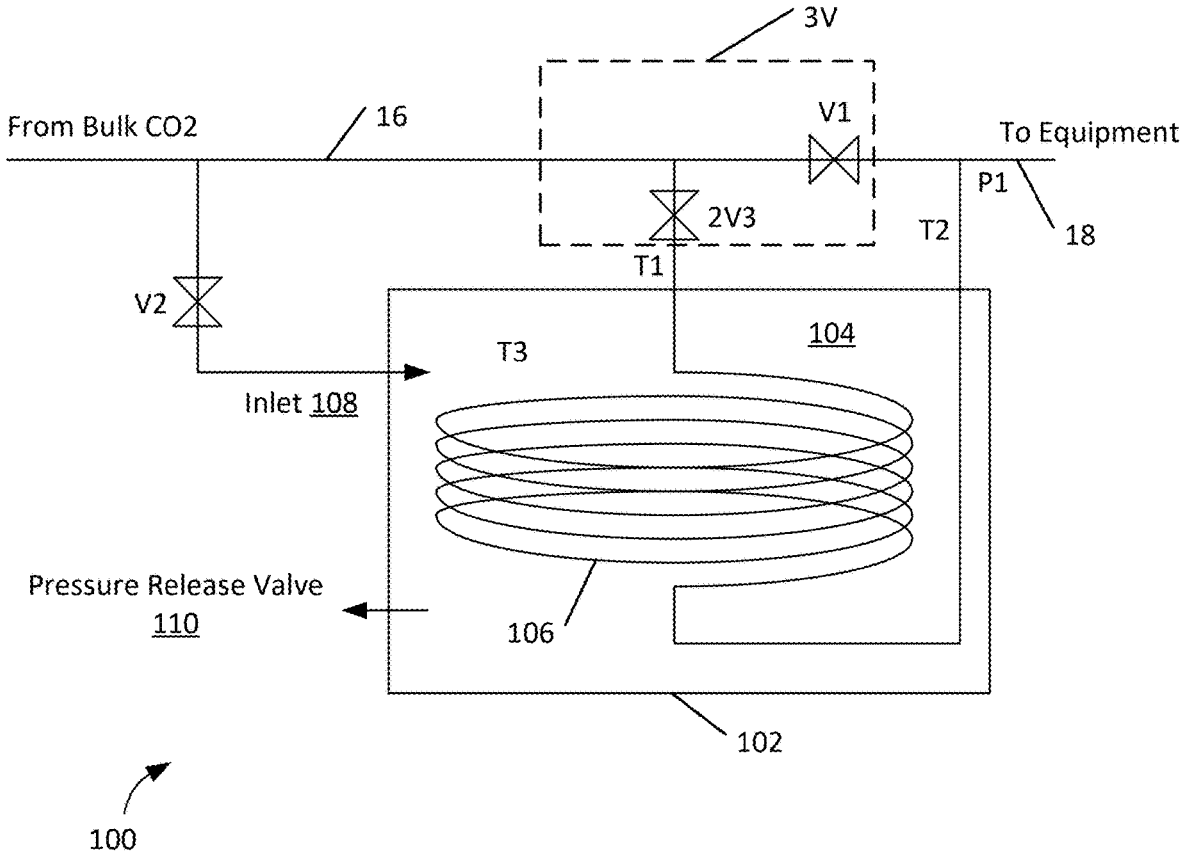
FIG. 2 illustrates an example subcooler useable in a carbon dioxide distribution system.

It is noted that the supply line 16 may be provided in a plurality of portions in some cases. In the example shown in FIG. 1, supply line 16 extends between the supply tank 12 and the subcooler 100, while a second supply line 18 connects between the subcooler 100 and the end equipment 14. Other portions may be included in the supply line as well. Alternatively, a single supply line may be provided between the supply tank 12 and the end equipment 14, with the subcooler being positioned and connected in parallel with such a supply line. This alternative arrangement is illustrated in FIGS. 2 and 4, below. The two possible arrangements are generally equivalent to one another, but may require slightly different valve control operations to manage operation of the subcooler 100, described in conjunction with FIGS. 3-4, respectively.

FIG. 2 illustrates an example subcooler 100 useable in a carbon dioxide distribution system. In the example shown, the subcooler 100 has an enclosure 102 defining an interior volume 104. The enclosure 102 may be an insulated enclosure, such as a vacuum insulated enclosure. The interior volume 104 may be empty, or many alternately be at least partially filled with an antifreeze solution, such as a glycol. Examples describing use of glycol are described in further detail below in conjunction with FIGS. 7A-7B.

Figure 8:
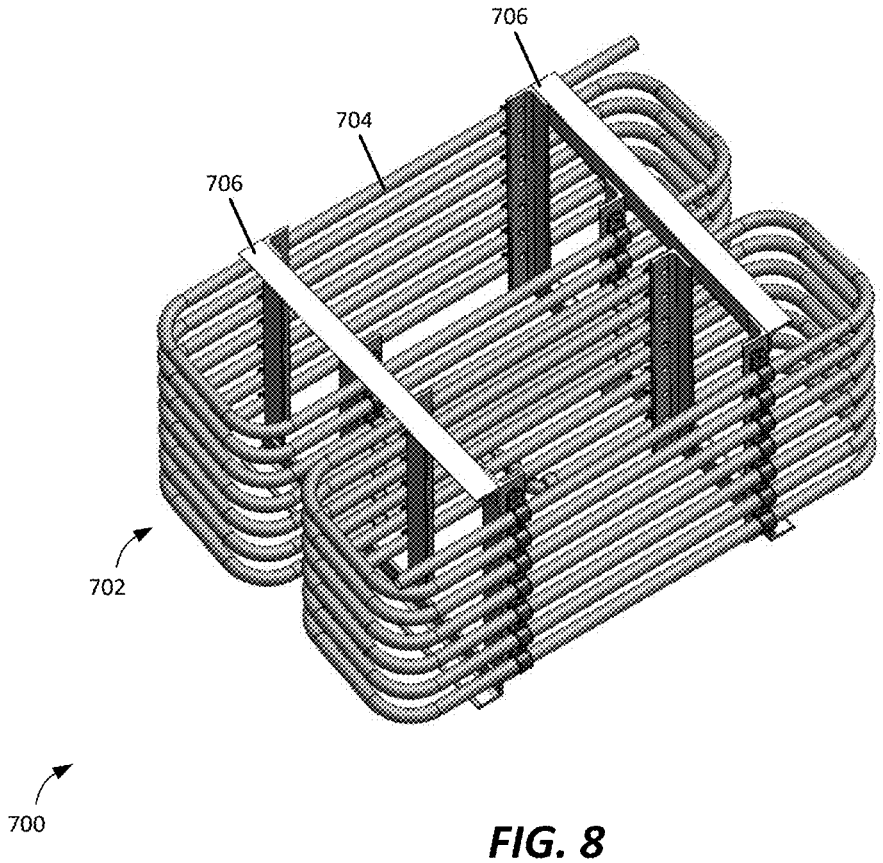
FIG. 8 is a top perspective view of a coil assembly useable within the subcooler described herein.
Figure 9:
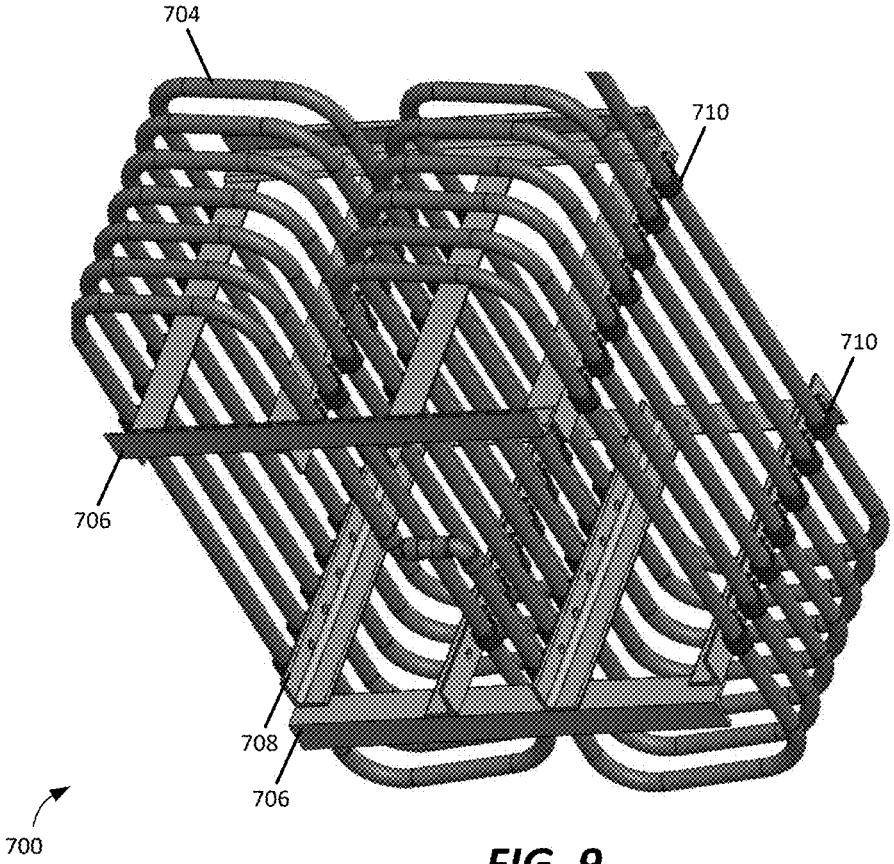
FIG. 9 is a bottom perspective view of the coil assembly of FIG. 8.

As illustrated, the subcooler 100 has a supply inlet and supply outlet fluidically connected via a coil 106. The coil 106, shown schematically in FIG. 2, may take a number of forms. In some examples, the coil may be constructed from bent or welded copper conduit to facilitate heat exchange. An example physical arrangement of such a coil is illustrated in FIGS. 7-9, described below.

The subcooler 100 may include a cooling inlet 108 and a pressure relief valve 110. The cooling inlet 108 may receive carbon dioxide from supply tube 16, e.g., via valve V2 (or valve 1V3 in the version seen in FIG. 1). The pressure release valve 110 may automatically open once pressure within the interior volume 104 exceeds a predetermined pressure (e.g., in the range of 20 to 40 PSI). Notably, the pressure within the interior volume 104 is significantly lower than a pressure within the supply tube 16, and as such, when carbon dioxide is introduced into the interior volume 104, its temperature drops rapidly. Accordingly, carbon dioxide passing through the coil 106 may be cooled via heat exchange with the lower-pressure carbon dioxide (and optionally glycol) mixture present in the interior volume 104.

In example embodiments, the pressure release valve 110 allows exhausting to the environment. However, in alternative embodiments, the pressure release valve 110 leads to an exhaust conduit that is fluidically connected to an exhaust outlet of the existing end equipment 14.

In example implementations, the subcooler may have various sizes. In some example embodiments, the subcooler 100 may be cylindrical, and have a diameter of about 10 inches and length of about three feet, thereby providing a sufficient number of coils to ensure cooling of the supply line carbon dioxide passing through the coil 106 to provide a reduction in temperature of 30 to 70 degrees in temperature (Fahrenheit). Accordingly, where a temperature at the end equipment 14 may have otherwise risen from −50 to −70 degrees, or from a range of −50 to −20 degrees, into a range of −20 to 0 degrees Fahrenheit or above, through use of the subcooler 100, a lower temperature may be maintained and/or reestablished at a location near the end equipment.

Referring to FIG. 2 generally, it is noted that the arrangement of the subcooler 100 relative to the supply tube 16 is somewhat different between FIGS. 1-2; either arrangement may be used in various embodiments. While in FIG. 1, a "flow through" arrangement is provided in which carbon dioxide supplied to end equipment 14 always flows through a coil of the subcooler 100, in the arrangement of FIG. 2, flow through the subcooler is optional, and is enabled by closing valve V1 and opening valve V3, thereby forcing fluid through the coil 106. However, in further embodiments, other valves may be incorporated into such a system to provide greater control over carbon dioxide flows through and/or past the subcooler 100.

In example embodiments, valves V1 and V3 may be implemented as separately-operable valves. However, in some embodiments, valves V2 and V3 may be implemented jointly as a 3-way valve, denoted as 3V in FIG. 2. Because valves V1 and V3 are typically operated in a manner opposite to each other in embodiments were continuous delivery of carbon dioxide to end equipment is desired, use of a three-way valve is generally equivalent to use of V1, V3. However, in a circumstance where flow of carbon dioxide to end equipment 14 is desired to be halted, V1 and V3 may be desired to be implemented separately to provide added control options (e.g., closing or opening both valves at once).

Still further, in some embodiments, fewer than all of the temperature probes may be used. In some example embodiments, discussed below, only a temperature probe T3 in FIG. 2, measuring an operating temperature of an interior of the subcooler (e.g., a temperature of a glycol solution used to maintain the subcooler internal temperature) may be monitored, with actuation of valves performed in response to that temperature. Details regarding specific operation of such an embodiment are provided below.

Figure 3:
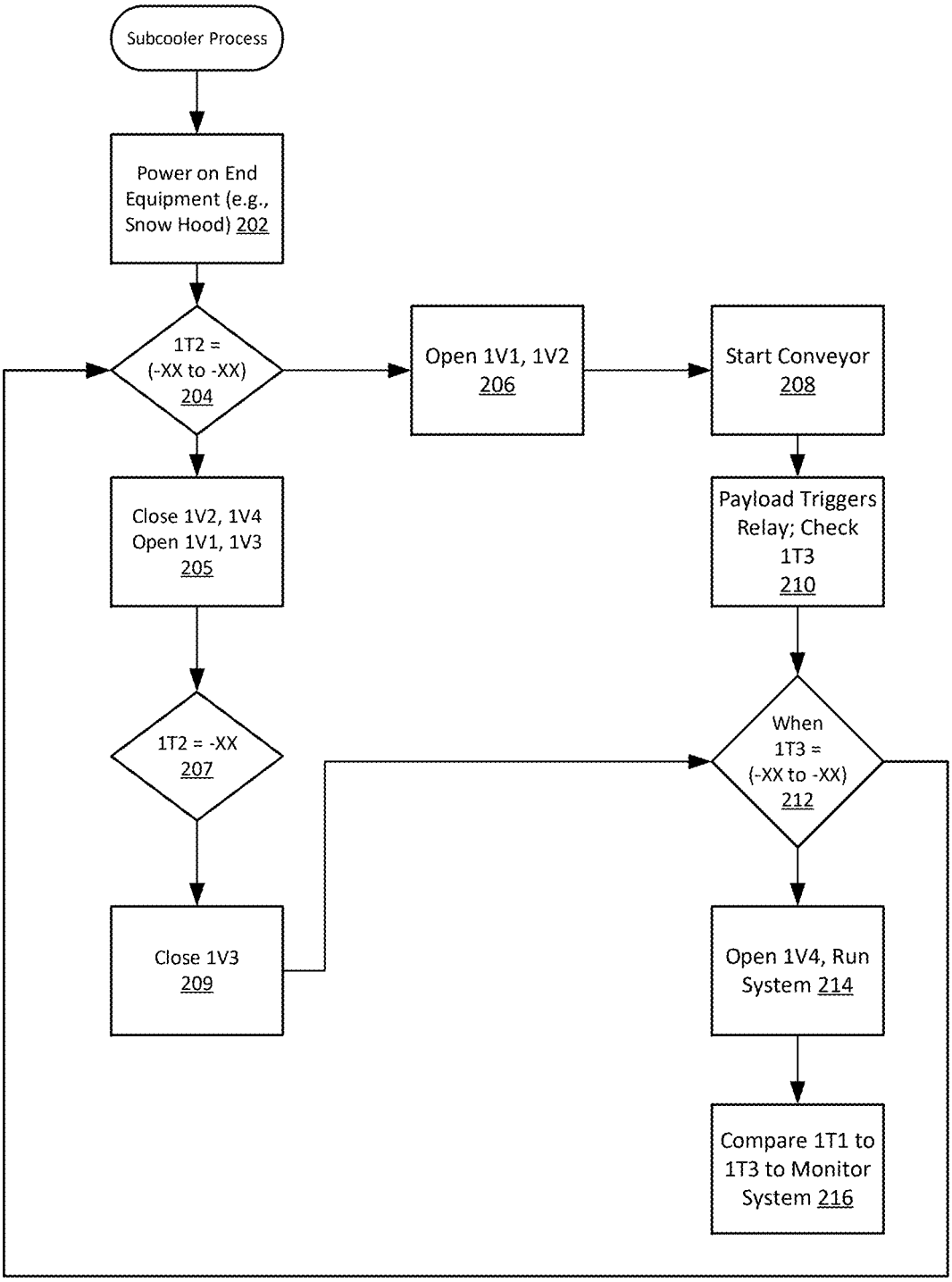
FIG. 3 is a flowchart of a process for control of the carbon dioxide distribution within the system of FIG. 1.
Figure 4:
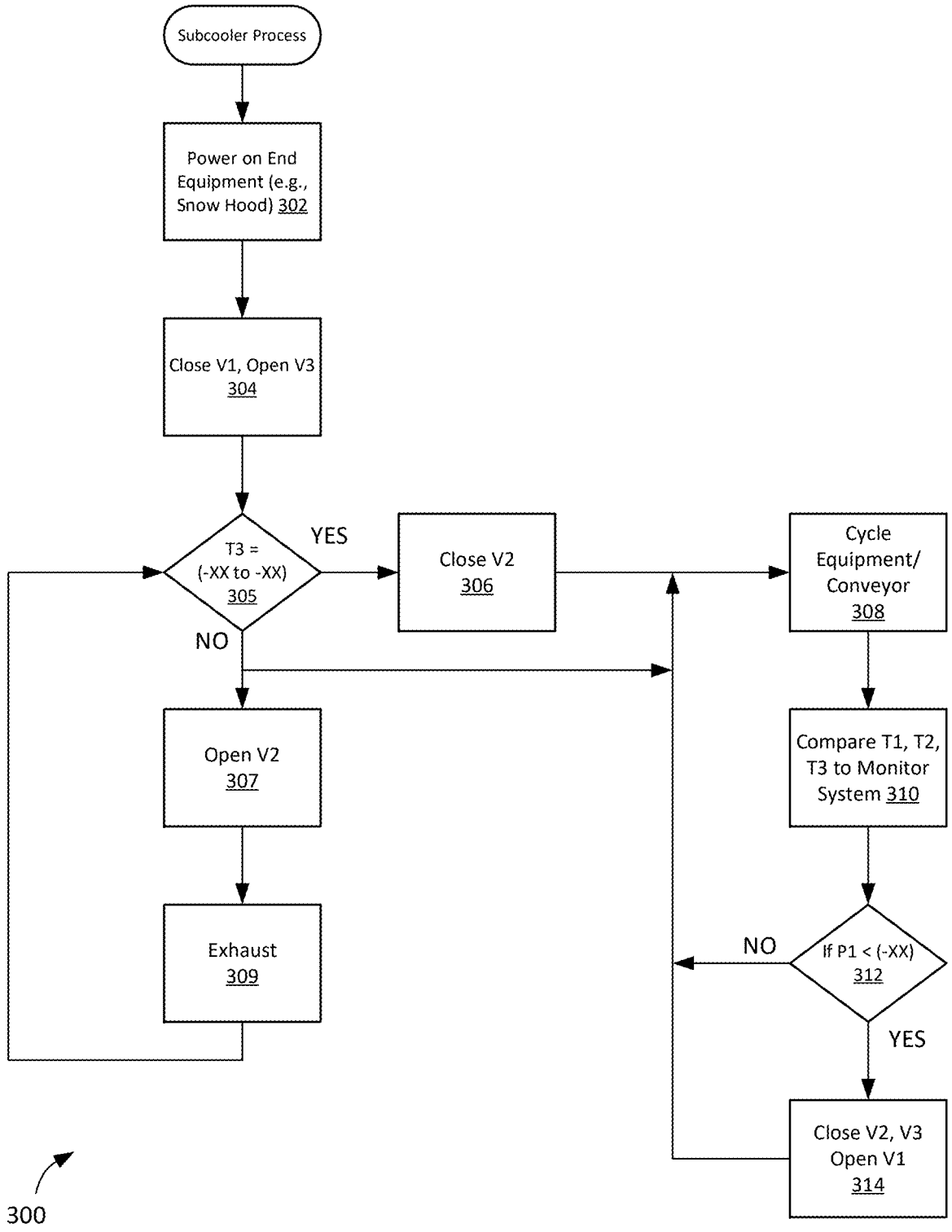
FIG. 4 is a flowchart of a process for control of the carbon dioxide distribution within the system of FIG. 2.

Referring now to FIG. 3, a process 200 for control of the carbon dioxide distribution within the system of FIG. 1 is shown. In the example shown in FIG. 3, the controller 20 of FIG. 1 may be used to actuate a series of valves to manage flow of carbon dioxide to and/or through the subcooler 100. In this example, the valve arrangement corresponds to valves 1V1, 1V2, 1V3, and 1V4, as well as a temperature probe (e.g., probe 1T2) within the interior volume of the subcooler 100, as reflected in FIG. 1.

In the embodiment shown, the process 200 includes activating end equipment (step 202). The end equipment may be, for example, a snow hood configured to generate dry ice; however, as noted above, other equipment may be used as well. While the end equipment is in operation, the process 200 may further include monitoring a temperature of the carbon dioxide at the subcooler 100 (e.g., at a location proximate to the end equipment) (step 204). In particular, the temperature is monitored to determine whether it is within a predetermined range.

In some example embodiments, the operating temperature range may be between −70 and −50 degrees Fahrenheit. In alternative examples, the operating temperature range may be between −50 and −20 degrees Fahrenheit, with a target operating temperature of approximately −40 degrees.

If the temperature is within the predetermined range, the controller 20 may open valves 1V1 and 1V2 (as seen in FIG. 1) (step 206) and start a conveyor of the supply carbon dioxide (step 208). Upon receipt of a payload, the controller 20 may check the temperature at temperature probe 1T3 (e.g., downstream of the subcooler 100) (step 210).

Upon determining that the temperature probe 1T3 reads a temperature within the predetermined acceptable operating range (e.g., −50 to −70 degrees Fahrenheit, −50 to −20 degrees Fahrenheit, or some other similar range typically below −20 degrees Fahrenheit) (step 212), valve 1V4 is opened and the snow hood (or other end equipment) is allowed to be operated (step 214). If, at step 212, the temperature is not within an acceptable operating range, operational flow may return to, e.g., step 204, for reassessment and comparison of temperatures at 1T3 to 1T2, and potentially reintroducing additional carbon dioxide into the interior volume of the subcooler 100 to provide additional cooling effect (e.g., via steps 205, 207, 209, below).

If the temperature is not within the predetermined range, valves 1V2 and 1V4 are closed, and valves 1V1 and 1V3 are opened (step 205). This provides supply carbon dioxide into the interior volume of the subcooler 100 rather than through the supply tube 16. Accordingly, a temperature of the subcooler 100 will drop as liquid carbon dioxide freezes within the interior volume at lower pressure. Temperature probe 1T2 will be monitored (step 207) until a temperature within the predetermined temperature range is reached. Until such a temperature is reached, supply carbon dioxide is continued to be provided into the interior volume. However, once the temperature is reached, valve 1V3 may be closed (step 209) and operation may proceed with step 212 (e.g., checking temperature and initiating operation of end equipment).

It is noted that, in alternative embodiments, the controller may operate so as to concurrently allow carbon dioxide through the subcooler (e.g., from the supply tank 12 to end equipment 14) as well as through the subcooler (e.g., into the interior volume). In such an instance, all valves (e.g., 1V1, 1V2, 1V3, 1V4) will be open concurrently, to allow flow toward the end equipment 14 to continue while the subcooler operates to gradually add a cooling effect to the supply.

Additionally, although the process 200 described in FIG. 3 results in valve actuations based on the current values of temperatures at 1T1, 1T2, 1T3, in some example embodiments, historical temperature values may be used to predict a rate at which cooling (or warming, when the subcooler 100 is not being supplied by carbon dioxide into its interior volume) occurs. By assessing rate of cooling/warming, the controller 20 could more reduce the overall temperature range differential and more easily keep the carbon dioxide supply to the end equipment within an operating range, rather than waiting for detection of a temperature outside the operating range to supply further carbon dioxide into the interior volume of the subcooler.

FIG. 4 illustrates a further process 300 for control of the carbon dioxide distribution using a subcooler 100, but using the valve arrangement seen in FIG. 2 instead of that shown in FIG. 1. In the example shown in FIG. 4, the controller 20 of FIG. 1 may be used, but with the valve arrangement of FIG. 2, to actuate valves to manage flow of carbon dioxide to and/or through the subcooler 100. In this example, the valve arrangement corresponds to valves V1, V2, and V3, as well as temperature probes T1, T2, T3, and a pressure sensor P1, as reflected in FIG. 2.

In the embodiment shown, the process 300 includes activating end equipment (step 302). As noted above, the end equipment may be, for example, a snow hood configured to generate dry ice; however, as noted above, other equipment may be used as well. The process 300 can also include closing valve V1 and opening valve V3, thereby causing a supply of liquid carbon dioxide to pass through the coil 106 of the subcooler (step 304). In this instance, valve V2 is also open, providing carbon dioxide supply to an interior of the subcooler 100. The lower pressure within the subcooler causes temperature therein to drop.

After the liquid carbon dioxide is passed through the subcooler, a temperature at at least temperature sensor T3 is determined (at operation 305). In some cases, other temperatures are determined, such as a temperature at temperature sensor T2. If the temperature is within a predetermined acceptable range for supply to end equipment (e.g., between −70 and −50 degrees Fahrenheit, or in some instances between −50 and −20 degrees Fahrenheit, as noted above), valve V2 may be closed (step 306). If the temperature is within the predetermined range, a controller may start a conveyor of the supply carbon dioxide (step 308).

At this stage, temperature sensors T1, T2, and T3 are compared to monitor system operation (e.g., comparing the input and output temperature at the subcooler as well as the temperature within the subcooler body itself) (step 310). Additionally, a pressure is detected at P1 (e.g., a pressure supplied to the end equipment, at operation 312). If the pressure is below a predetermined threshold, the equipment may be allowed to continue to operate, with operational flow returning to step 308. However, if pressure is not below a predetermined threshold, that may indicate that additional flow to the end equipment is desirable. In this instance, valves V2 and V3 can be closed (the valves into and out from the subcooler) and valve V1 may be opened (step 312). This has the effect of bypassing the subcooler entirely.

It is noted that if, at operation 305, the temperature within the subcooler 100 is not within an appropriate operating range (as determined via temperature sensor T2), valve V2 may be opened (step 307), thereby supplying carbon dioxide from the supply line to the interior of the subcooler. Additionally, because supply is provided to the interior volume of the subcooler, exhausting may occur to maintain the subcooler at a predetermined, lower pressure as compared to the pressure within the supply line (step 309), for example via pressure release valve 110. This may be repeated and/or continued until the lowered-pressure supply causes cooling of the temperature within the subcooler to the operating range.

It is noted that in FIG. 4, the cooling of the interior of the subcooler may be performed either concurrently with, or as an alternative to, operation of the end equipment. In other words, supply carbon dioxide may be provided concurrently to end equipment and to the interior of the subcooler (e.g., via valves V2, V3, or valves V2, V1).

As with the method described above in conjunction with FIG. 3, in some example embodiments, historical temperature values may be used to predict a rate at which cooling (or warming, when the subcooler 100 is not being supplied by carbon dioxide into its interior volume) occurs. By assessing rate of cooling/warming, a controller could more reduce the overall temperature range differential and more easily keep the carbon dioxide supply to the end equipment within an operating range, rather than waiting for detection of a temperature outside the operating range to supply further carbon dioxide into the interior volume of the subcooler.

Figure 5:
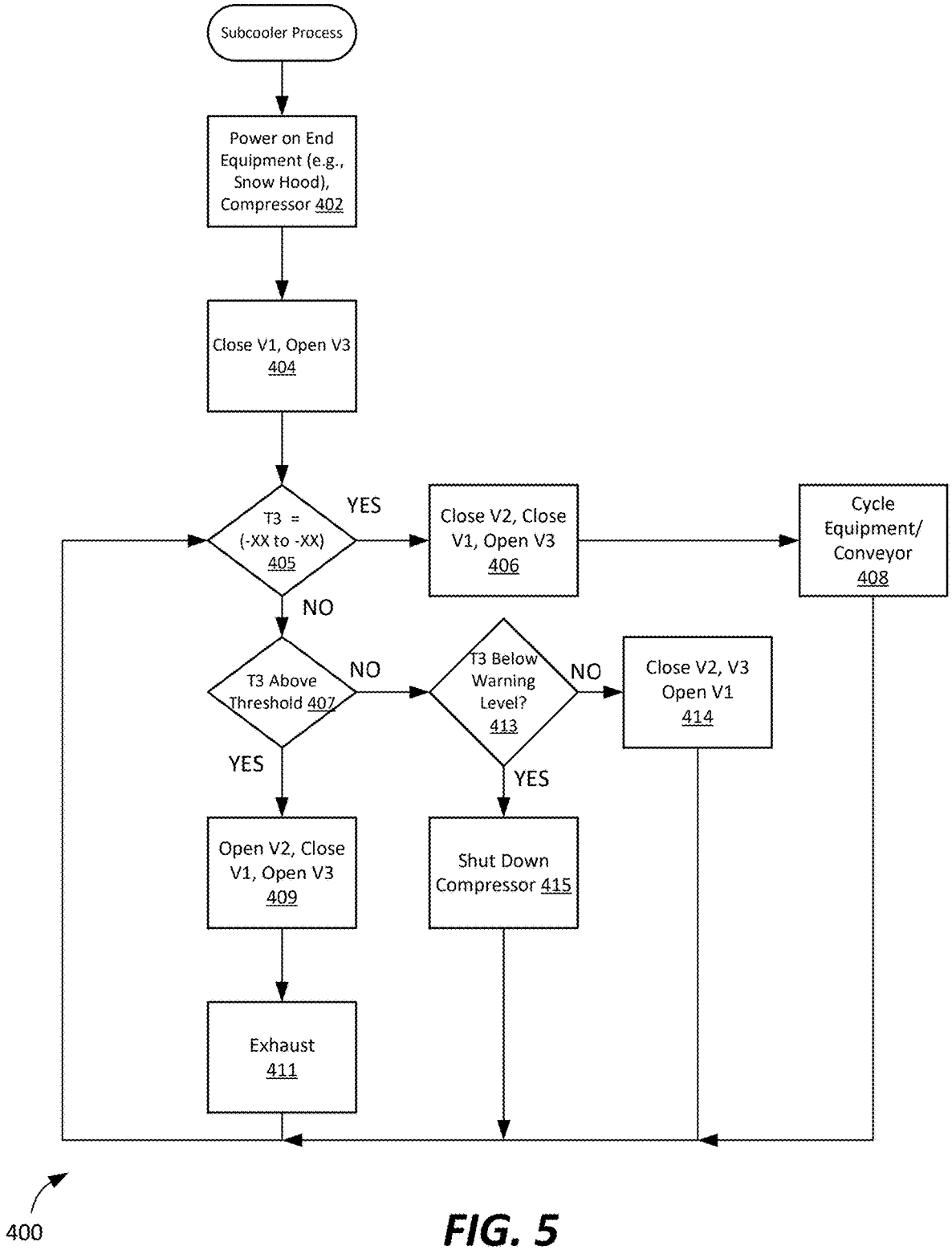
FIG. 5 is a flowchart of an alternative process for control of the carbon dioxide distribution within the system of FIG. 2.

FIG. 5 illustrates an alternative example of a process 400 for control of the carbon dioxide distribution using a subcooler 100, but using the valve arrangement seen in FIG. 2. Process 400 may be used, for example, where fewer temperature sensors are utilized, for example only using a temperature sensor internal to the subcooler (e.g., T3).

In the example shown, the process 400 includes activating end equipment (step 402). As noted above, the end equipment may be, for example, a snow hood configured to generate dry ice; however, as noted above, other equipment may be used as well. The process 400 can also include closing valve V1 and opening valve V3 (or adjusting a three-way valve 3V that is in place of those valves), thereby causing a supply of liquid carbon dioxide to pass through the coil 106 of the subcooler (step 404). In this instance, valve V2 is also open, providing carbon dioxide supply to an interior of the subcooler 100. The lower pressure within the subcooler causes temperature therein to drop.

After the liquid carbon dioxide is passed through the subcooler, a temperature at at least temperature sensor T3 is determined (at operation 405). If the temperature is within a predetermined range (e.g., between −70 to −50° F., or an alternative examples, between −50 to −20° F.), valve V2 is closed, valve V1 is closed, and valve V3 is opened, thereby routing the carbon dioxide supply through the coil 106 within the subcooler 100 (step 406). The operating equipment may then be cycled for operation (step 408).

If, at operation 405, temperature T3 is outside of the desired operating range, it is then determined whether the temperature from T3 is above a predetermined threshold outside of the operating range (step 407). If temperature at T3 is above the threshold (e.g., warmer than the desired operating range), valve V2 may be opened, valve V1 may be closed, and valve V3 may be opened (at step 409). Alternately, the three way valve 3V may be actuated to change flow from being directed into the subcooler 100 and toward the end equipment. Accordingly, in this configuration, the subcooler is bypassed, with carbon dioxide flowing directly to end equipment 14. Concurrently, carbon dioxide supply is provided to the interior of the subcooler, to provide cooling and bringing the sun cooler internal volume back into an operating range. To avoid over pressure conditions, and exhaust operation may also be performed while carbon dioxide is supplied into the subcooler (step 411).

If, at operation 407, it is determined that temperature T3 is not above a threshold (e.g. the temperature is below the threshold level), it is determined whether T3 is below a warning level for operation (step 413). A warning level may correspond to a level outside of preferred operating range, but during which operation may continue. This may occur, for example, if the subcooler begins to accumulate frost or other conditions adverse to operation. Warning levels may be selected to be slightly outside of a preferred operating range (e.g., if an operating range of −50 to −20 degrees Fahrenheit is used, a warning level may be provided in a range of −70 to −50 degrees Fahrenheit).

If it is determined that the temperature at T3 is not yet outside of the warning level, valve V2 may be closed, valve V3 a be closed, and valve V1 may be opened (step 414). This results in complete bypass of the subcooler 100, thereby continuing to supply carbon dioxide to end equipment 14 while allowing the subcooler 100 time to warm back into an appropriate operating range.

If, at operation 413, it is determined that temperature at T3 is below even the warning level threshold, a condition may be occurring that should not allow operation of the end equipment to continue. Accordingly, a compressor may be shut down, thereby ending supply of carbon dioxide to the end equipment 14 (step 415).

Figure 6:
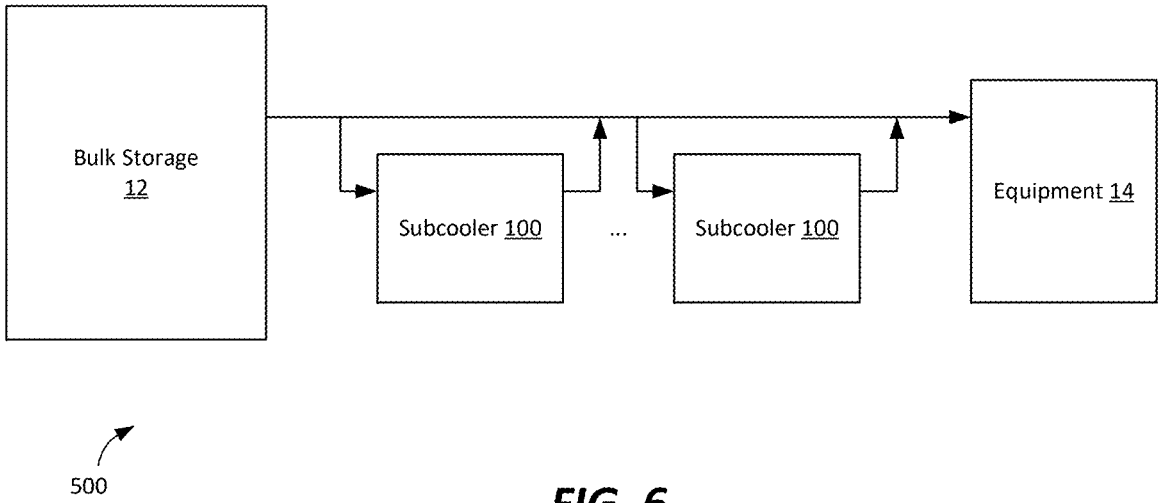
FIG. 6 is a schematic block diagram of a further example modification of the carbon dioxide distribution systems described herein.

FIG. 6 is a schematic block diagram of a second example carbon dioxide distribution system 500. The carbon dioxide distribution system 500 generally represents a similar configuration to that seen in FIG. 1, but with the parallel connection scheme of FIG. 2, in which each subcooler 100 is positioned in parallel with the supply line rather than requiring the supply line to run through each subcooler. However, it is noted that the arrangement of the subcooler 100 of FIG. 1 could also be used in connection with the carbon dioxide distribution system 500.

As illustrated, a supply tank 12 is fluidically connected to end equipment 14 via a supply tube 16, similarly to FIGS. 1-2. However, in this example, a plurality of subcoolers 100 may be distributed along a length of the supply tube 16. In this arrangement, the end equipment 14 may be positioned at a significant distances from the supply tank 12, with subcoolers being used at a plurality of spaced-apart locations such that an adequate temperature range is maintained through the length of the supply tube. Because each subcooler might only reduce temperature by 30-50 degrees Fahrenheit, and because exposure to ambient temperature over an extended length of supply tube may raise temperature by greater than that amount, it may be advisable to include multiple such subcoolers in series to provide additional cooling capabilities.

Figure 7A:
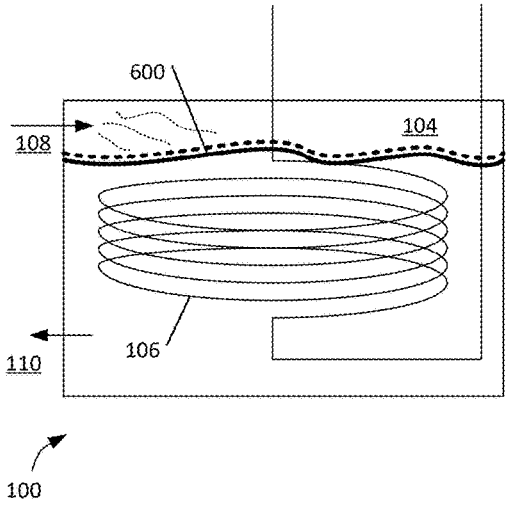
FIGS. 7A-7B illustrate techniques for introducing carbon dioxide into an interior volume of a subcooler, in accordance with example embodiments.
Figure 7B:
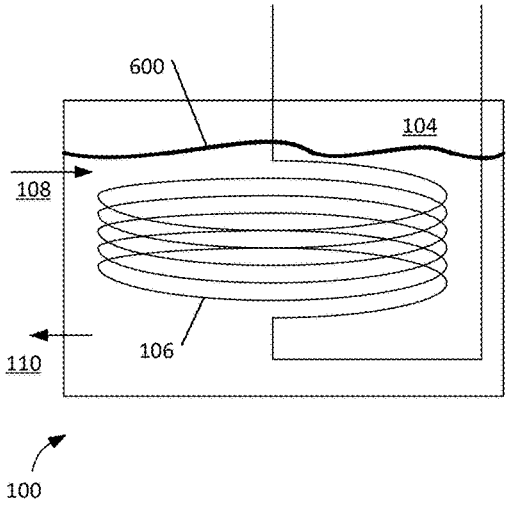

Referring to FIGS. 7A-7B, additional example embodiments of the subcooler 100 are described. Generally, the subcooler 100 as shown in these figures corresponds to the embodiments of FIGS. 1-2, above, and may be operable using the methods of FIGS. 3-5, respectively. In these examples, a glycol solution may at least partially fill the interior volume 104 of the subcooler 100. Typically, the glycol solution may have a fill level 600 that at least partially covers the coil 106 positioned within the subcooler 100. However, the location of the cooling inlet 108 directly into the interior volume 104 relative to the fill level 600 of the glycol solution may vary. In FIG. 7A, the cooling inlet 108 is positioned above a chosen fluid level 600 of the glycol. In this arrangement, liquid carbon dioxide may enter the interior volume 104 and may expand due to the lower pressure, causing formation of a carbon dioxide "snow" that falls onto and cools the glycol solution. In FIG. 7B, the cooling inlet 108 is positioned below a liquid fill level 600 of the glycol, causing the liquid carbon dioxide to be directly introduced into that solution to cause cooling.

It is noted that although the pressure relief valve is shown as below a level of the glycol, this is merely schematic; in alternative embodiments, the pressure relief valve may be located above the fluid level of the glycol to ensure that any pressure exhausting results in emission of gaseous carbon dioxide, rather than loss of glycol.

Figure 10:
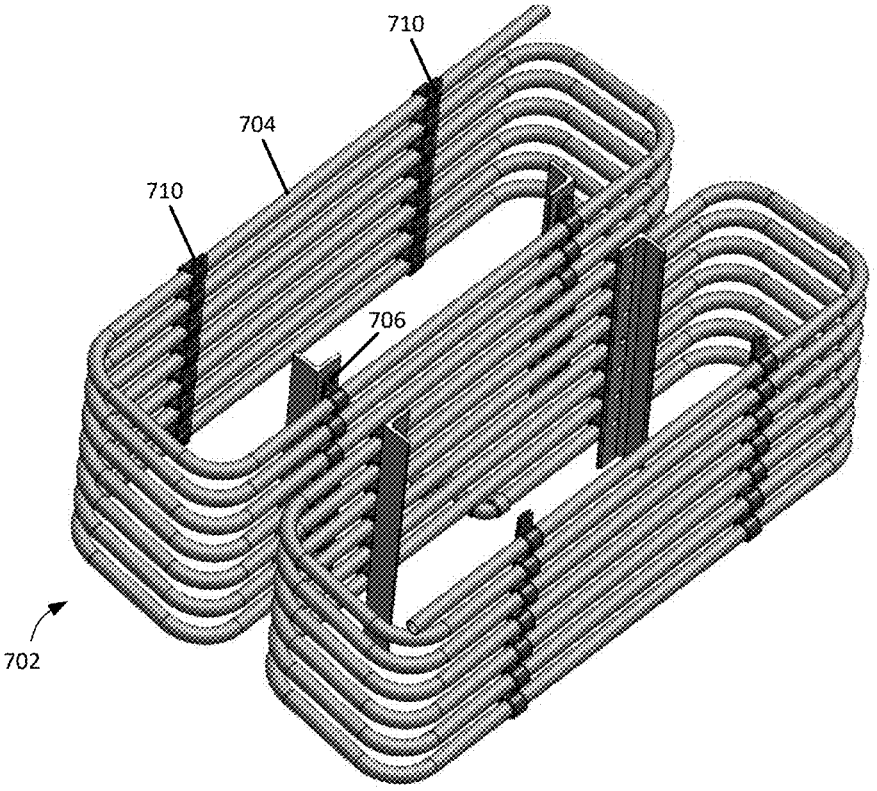
FIG. 10 is a further top perspective view of a portion of the coil assembly of FIG. 8.

Referring now to FIGS. 8-10, perspective views of a coil assembly 700 are provided. The coil assembly 700 may be used, for example, as the coil 106 illustrated schematically above. The coil assembly 700 includes a copper coil subassembly 702 constructed from copper conduit 704, and mounted to support rails 706. In the example shown, the copper coil subassembly 702 includes a pair of coil stacks fluidic we coupled in a continuous pair of adjacent loops, with inlet and outlet ends of the copper conduit 704 being located at a top side of the coil assembly 700. Accordingly, the pair of coil stacks formed by the copper coil subassembly 702 route fluid down from an inlet into the glycol solution described above and through one of those coil stacks, and back up through the other of the coil stacks toward the outlet.

To maintain the structure of the copper coil subassembly 702, a plurality of mounting brackets 710 are mounted to vertical supports 708 extending from the support rails 706. Each of the mounting bracket 710 may be placed to surround and/or support a portion of copper conduit 704, thereby maintaining the positioning of the copper coil subassembly 702.

Although the copper coil subassembly 702 is generally shown as being formed from a pair of generally rectangular coil structures, other configurations may be used as well, consistent with the principles described herein.

While particular uses of the technology have been illustrated and discussed above, the disclosed technology can be used with a variety of data structures and processes in accordance with many examples of the technology. The above discussion is not meant to suggest that the disclosed technology is only suitable for implementation with the data structures shown and described above.

This disclosure described some aspects of the present technology with reference to the accompanying drawings, in which only some of the possible aspects were shown. Other aspects can, however, be embodied in many different forms and should not be construed as limited to the aspects set forth herein. Rather, these aspects were provided so that this disclosure was thorough and complete and fully conveyed the scope of the possible aspects to those skilled in the art.

As should be appreciated, the various aspects (e.g., operations, memory arrangements, etc.) described with respect to the figures herein are not intended to limit the technology to the particular aspects described. Accordingly, additional configurations can be used to practice the technology herein and/or some aspects described can be excluded without departing from the methods and systems disclosed herein.

Similarly, where operations of a process are disclosed, those operations are described for purposes of illustrating the present technology and are not intended to limit the disclosure to a particular sequence of operations. For example, the operations can be performed in differing order, two or more operations can be performed concurrently, additional operations can be performed, and disclosed operations can be excluded without departing from the present disclosure. Further, each operation can be accomplished via one or more sub-operations. The disclosed processes can be repeated.

Although specific aspects were described herein, the scope of the technology is not limited to those specific aspects. One skilled in the art will recognize other aspects or improvements that are within the scope of the present technology. Therefore, the specific structure, acts, or media are disclosed only as illustrative aspects. The scope of the technology is defined by the following claims and any equivalents therein.

The invention claimed is:

1. A carbon dioxide distribution system comprising:

a supply tank;

end equipment;

a carbon dioxide supply line fluidically connected between the supply tank and the end equipment;

a subcooler located along the carbon dioxide supply line, the subcooler comprising:

an insulated enclosure forming an interior volume, the insulated enclosure having a supply inlet fluidically connected to the supply tank via the carbon dioxide supply line, a supply outlet fluidically connected to the end equipment via the carbon dioxide supply line, and a cooling inlet in fluidic communication with both the carbon dioxide supply line and the interior volume; and a coil supply tube positioned within the interior volume, the coil supply tube being fluidically connected between the supply inlet and the supply outlet;

a plurality of temperature sensors including at least an inlet temperature sensor, an interior temperature sensor, and a supply temperature sensor;

a plurality of valves fluidically connected along the carbon dioxide supply line; and a controller operatively connected to each of the plurality of temperature sensors and the plurality of valves, the controller being operable to control the plurality of valves to direct flow of carbon dioxide between the supply tank and the end equipment and selectively through the subcooler based, at least in part on a temperature sensed by at least one of the plurality of temperature sensors, wherein the controller is configured to:

actuate a first valve of the plurality of valves to introduce carbon dioxide from the carbon dioxide supply line into the interior volume of the subcooler when a temperature within the interior volume of the subcooler is outside an acceptable operating range; and actuate a second valve of the plurality of valves to direct the carbon dioxide to flow through the coil supply tube positioned within the interior volume of the subcooler and route the carbon dioxide between the supply tank and the end equipment when the temperature within the interior volume of the subcooler is within the acceptable operating range.

2. The carbon dioxide distribution system of claim 1, wherein the subcooler is located proximate to the end equipment.

3. The carbon dioxide distribution system of claim 1, wherein the end equipment comprises a snow hood.

4. The carbon dioxide distribution system of claim 1, wherein the supply line includes a first portion extending between the supply tank and the subcooler and a second portion extending between the subcooler and the end equipment.

5. The carbon dioxide distribution system of claim 1, wherein the subcooler is fluidically connected in parallel with the carbon dioxide supply line.

6. The carbon dioxide distribution system of claim 1, further comprising a glycol bath within the interior volume.

7. The carbon dioxide distribution system of claim 1, further comprising a second subcooler located along the carbon dioxide supply line between the supply tank and the end equipment.

8. The carbon dioxide distribution system of claim 1, wherein the controller is further configured to, based on a determination that the temperature within the interior volume of the subcooler is within an acceptable range, actuate the first valve to halt introduction of carbon dioxide into the interior volume.

9. The carbon dioxide distribution system of claim 1, wherein the subcooler includes a glycol solution within the interior volume at a glycol fill level, and wherein the method includes actuating the first valve to introduce carbon dioxide from the carbon dioxide supply line into the interior volume includes introducing the carbon dioxide at a location within the interior volume positioned above the glycol fill level.

10. The carbon dioxide distribution system of claim 1, wherein the acceptable operating range comprises a range between −50 to −20 degrees Fahrenheit.

11. The carbon dioxide distribution system of claim 1, wherein the controller is further configured to, based on a determination that the temperature is outside of the acceptable operating range, actuate a third valve to supply carbon dioxide from the carbon dioxide supply line to the end equipment, bypassing the subcooler.

12. A carbon dioxide subcooler comprising:

an insulated enclosure forming an interior volume, the insulated enclosure having a supply inlet, a supply outlet, and a cooling inlet in fluidic communication with the interior volume;

a coil supply tube positioned within the interior volume, the coil supply tube being fluidically connected between the supply inlet and the supply outlet;

a control valve controlling supply of carbon dioxide into the interior volume via the cooling inlet;

a supply valve actuatable to allow carbon dioxide to flow from a supply tube into the supply inlet;

a plurality of temperature sensors including at least an inlet temperature sensor, an interior temperature sensor, and a supply temperature sensor; and a controller configured to control:

actuation of the control valve to direct flow of the carbon dioxide from the cooling inlet into the interior volume when a temperature within the interior volume is outside an acceptable operating range; and actuation of the supply valve to direct the carbon dioxide to flow through the coil supply tube positioned within the interior volume when the temperature within the interior volume is within the acceptable operating range.

13. The carbon dioxide subcooler of claim 12, wherein the insulated enclosure comprises a vacuum-insulated enclosure.

14. The carbon dioxide subcooler of claim 12, further comprising a glycol bath within the interior volume.

* * * * *